US007775327B2

(12) United States Patent
Abraham et al.

(10) Patent No.: US 7,775,327 B2
(45) Date of Patent: Aug. 17, 2010

(54) METHOD AND SYSTEM FOR STOPPING ELEVATORS USING AC MOTORS DRIVEN BY STATIC FREQUENCY CONVERTERS

(75) Inventors: Detlev Abraham, Borgsdorf (DE); Hans-Josef Mennen, Niederkrüchten (DE)

(73) Assignee: Danfoss A/S, Nordborg (DK)

( * ) Notice: Subject to any disclaimer, the term of this patent is extended or adjusted under 35 U.S.C. 154(b) by 816 days.

(21) Appl. No.: 10/586,900

(22) PCT Filed: Jan. 25, 2005

(86) PCT No.: PCT/DE2005/000115

§ 371 (c)(1),
(2), (4) Date: Mar. 8, 2007

(87) PCT Pub. No.: WO2005/073121

PCT Pub. Date: Aug. 11, 2005

(65) Prior Publication Data

US 2007/0187185 A1 Aug. 16, 2007

(30) Foreign Application Priority Data

Jan. 30, 2004 (DE) ..... 10 2004 006 049

(51) Int. Cl.
*B66B 1/32* (2006.01)

(52) U.S. Cl. ..... 187/288; 187/393

(58) Field of Classification Search ..... 187/247, 187/277, 286, 295–297, 391–393; 318/434, 318/454, 455, 474, 478, 479; 361/30, 79
See application file for complete search history.

(56) References Cited

U.S. PATENT DOCUMENTS

| | | | | |
|---|---|---|---|---|
| 4,479,565 | A | 10/1984 | Nomura | 187/29 |
| 5,247,140 | A * | 9/1993 | Iwasa et al. | 187/288 |
| 5,698,823 | A * | 12/1997 | Tanahashi | 187/296 |
| 6,056,088 | A | 5/2000 | Gerstenkorn | 187/390 |
| 6,422,350 | B1 | 7/2002 | Erker | 187/277 |
| 7,374,020 | B2 * | 5/2008 | Smith et al. | 187/289 |

FOREIGN PATENT DOCUMENTS

EP 0 903 314 B1 9/1998

OTHER PUBLICATIONS

"Safety rules for the construction and installation of lifts—Part 1: Electric lifts", European Committee for Standardization, Ref. No. EN 81-1:1998 E, pp. 33-35 (Aug. 1998).

(Continued)

*Primary Examiner*—Jonathan Salata
(74) *Attorney, Agent, or Firm*—McCormick, Paulding & Huber LLP

(57) ABSTRACT

The invention relates to methods for stopping elevators especially when using at least one three-phase motor operated by a static frequency converter. According to the invention, a brake relay controls the brake of the motor such that releasing of the brake relay causes the motor to be decelerated while the brake relay is coupled to a protective circuit in such a way that the control pulses required for generating the driving motor field are safely blocked when the brake relay is released.

8 Claims, 1 Drawing Sheet

OTHER PUBLICATIONS

"Safety of machinery—Safety-related parts of control systems—Part 1: General principles for design", European Committee for Standardization, Ref. No. EN 954-1:1996, pp. 1-32 (Dec. 1996).

Neuer, Modularer Universalumrichter Bietet Optimale Antriebslösungen Für Aufzüge, by Dr. Holger König, LIFT Report dated 29 Jahar. (2003); pp. 78-81; See English abstract on p. 81.

* cited by examiner

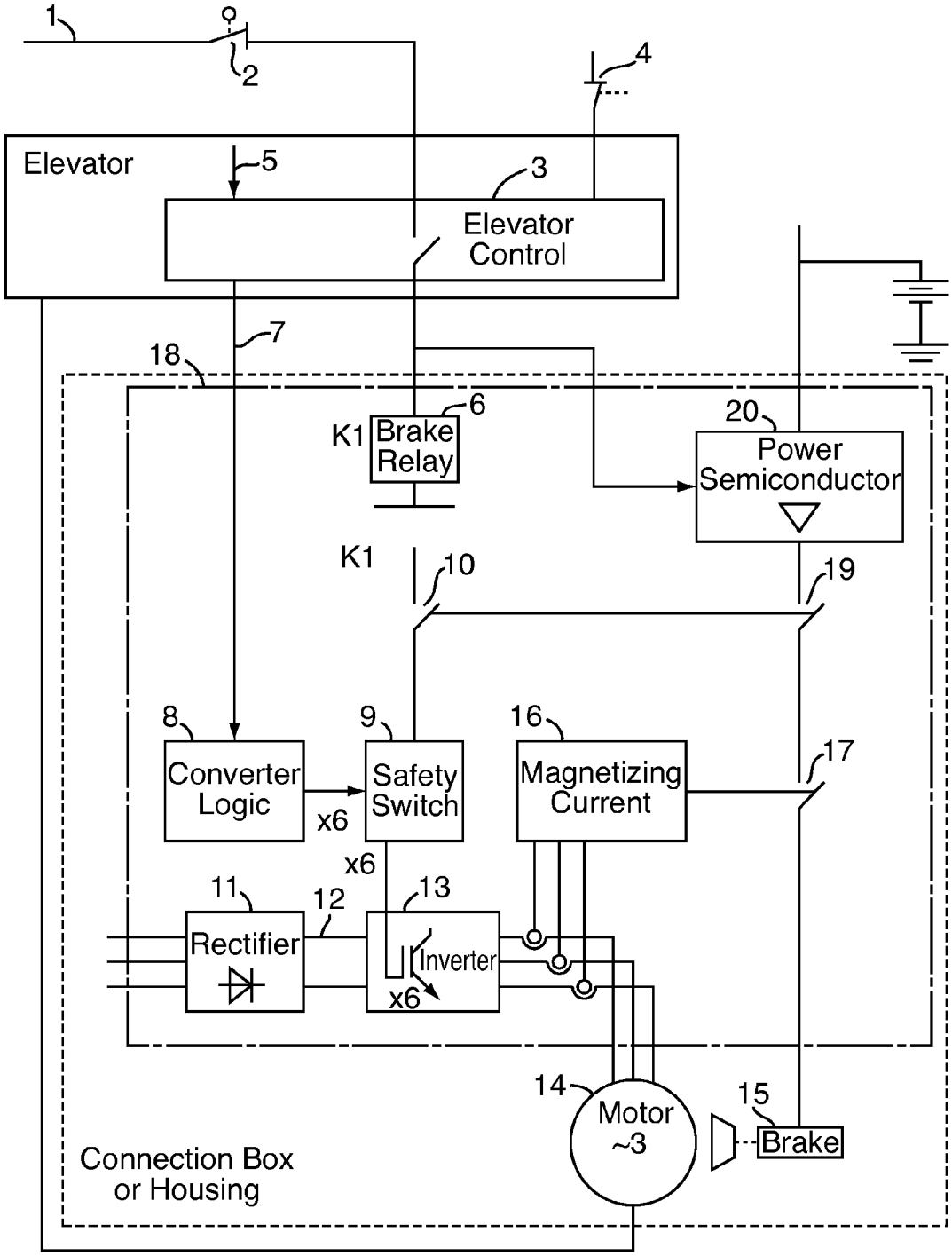
1
2
4
Elevator
5
3
Elevator Control
7
18
6
K1
Brake Relay
20
Power Semiconductor
K1
10
19
8
9
16
Converter Logic
Safety Switch
Magnetizing Current
17
x6
x6
11
12
13
Rectifier
Inverter
x6
14
Motor ~3
15
Brake
Connection Box or Housing

METHOD AND SYSTEM FOR STOPPING ELEVATORS USING AC MOTORS DRIVEN BY STATIC FREQUENCY CONVERTERS

CROSS REFERENCE TO RELATED APPLICATIONS

This application is entitled to the benefit of and incorporates by reference essential subject matter disclosed in International Patent Application No. PCT/DE2005/000115 filed on Jan. 25, 2005 and German Patent Application No. 10 2004 006 049.5 filed Jan. 30, 2004.

FIELD OF THE INVENTION

The invention concerns a method and a system for stopping elevators using AC-motors driven by static frequency converters.

BACKGROUND OF THE INVENTION

The stopping of drives for elevators is technically relevant from a safety point of view. When considering the functional course of elevators, the stopping after activation of a safety device and the unintentional starting during loading or unloading, respectively, are particularly essential.

In order to take these demands into account, the current supply to the motor is realised by means of two monitored relays or one monitored relay and one monitored control device, which interrupts the power supply by means of static components. This ensures that in the operation states mentioned above the motor can create no torque and the brake is engaged.

To this, DIN EN 81-1, point 12.7, states as follows:

The stopping of the elevator on activation of an electrical safety device must take place as follows:

In motors, which are supplied directly by the AC or DC mains, the power supply must be interrupted by two mutually independent relays, whose switching elements are connected in series in the motor current circuit.

If the main switching element of one of the relays has not opened when the elevator has stopped, a renewed starting must be prevented before the next direction change.

With a drive according to the Ward-Leonard system and generating the activation by classical means, two mutually independent relays must interrupt either:

a. the rotor circuit b. the energizing circuit of the generator c. one relay interrupts the rotor circuit and the other interrupts the energizing circuit of the generator.

When the main armature of one of the two relays does not open when the elevator stops, a renewed starting must be prevented before the next direction change.

With a supply and control of AC or DC motors with static means, the power supply to the motor must be interrupted by two mutually independent relays. When the main armature of one of the two relays does not open when the elevator stands still, a renewed starting must be prevented before the next direction change.

Alternatively, a circuit comprising:

1. a relay, which interrupts the power supply on all poles. The coil of the relay must be turned off at least before each change of operation direction. When the relay does not open, a renewed starting of the elevator must be prevented
2. a control device that interrupts the power supply in the static elements 3. a monitoring device that tests if the power supply is interrupted at each stop of the elevator must be provided.

During the trade fair SPS//PC/DRIVES 2002 a new system from the company Control Techniques, the Unidrive SP, was presented, which is intended to be an automation platform provide a number of new, innovative solutions for the elevator business. A related article on the subject in the magazine LIFT-REPORT, 29$^{th}$ volume (2003), No. 4, page 80, ends with the statement: "A TÜV approval according to EN 81-1 is in progress. This will permit saving one motor relay."

This outlined state of the art makes it clear that experts consider the motor protection principle as indispensable. This is in spite of the fact that state of the art involves substantial disadvantages.

Particularly with elevators without machine room, the space requirements and the noise generation of the relays to be used are disturbing. The high switching cycle prevents the use of a switching relay at the input of the frequency converter. Thus, it is difficult to locate the frequency converter directly at the motor. The costs of the relays, their mounting and wiring increase the manufacturing costs.

From an EMV point of view, the switching of the frequency converter outlet and thus the interruption of the screening is bad. It is also known that switching off the converter outlet at low motor frequencies generates higher contact erosion, which again causes a shorter life of the relays.

It is the task of the invention to eliminate these disadvantages and completely abandon the principle of using motor relays.

SUMMARY OF THE INVENTION

This task is solved with the features of a method for stopping elevators, particularly by using at least one AC motor driven by a static frequency converter, in which a brake relay controls the brake of the motor so that de-energizing the brake relay will brake the motor, the brake relay being connected with a safety switch in such a manner that de-energizing the brake relay will reliably block the control impulses required for generating the driving motor field and a system for implementation of said method, comprising an elevator safety circuit with preferably series-connected safety systems, acting via the elevator control upon the brake relay located in a frequency converter, said brake relay controlling the brake of the motor, the frequency converter comprising a frequency converter logic unit that produces control signals, used by the motor control power semiconductors contained in the inverter, for a rotating-field-producing pulse pattern, and a safety switch, which is on the one side connected to the brake relay and on the other side to the power semiconductors, so that de-energizing the brake relay will disconnect the torque-generating, rotating field of the motor. Advantageous embodiments of said method and system are disclosed herein.

According to the invention, the stopping of the drive is achieved by means of a switching structure, which on the one hand safely disconnects the control signals creating the rotating field, that is, removing a driving torque of the motor, and on the other hand causes the activation of the brake belonging to the drive.

Thus, the condition is utilised that AC motors can only generate a driving torque, when a rotating field is available at the winding.

When supplying AC motors through static frequency converters, the rotating field is generated by modulation of a direct voltage. This modulation usually occurs through 6 power semiconductors connected to the direct voltage and a logic unit, which emits the control impulses required for the modulation.

The safety system stopping the elevator works on the basis of a brake relay according to EN 954-1, category 4, integrated in the converter or on the basis of two monitored relays, which cause the actuation of the brake and at the same time act upon a safety switch according to EN 81-1. Thus, the safety switch interrupts the control impulses required for the modulation of the direct voltage. This prevents the generation of a rotating field creating motor torque.

With this invention, the frequency converter can be used for elevators without having relays at its outlet.

Thus, the converter can be located dose to the drive or in the motor connection box of the drive. This enables integrated driving solutions for elevators with little mounting effort. The disturbing switching noises of the relays are avoided. The elevator control can be made substantially more compact, as the relays are no longer required and the converter can be located at the motor. The screening of the motor cables is not interrupted by the relays, or, in the case that the converter is located in the motor housing, is no longer required.

The replacement of the relay contacts because of erosion is avoided. This facilitates the maintenance. The costs of the relays and their wiring are avoided.

DESCRIPTION OF THE DRAWING

The switch according to the invention will be explained by means of the drawing:

The sole FIGURE is a schematic of a safety circuit in accordance with one embodiment of the invention.

DETAILED DESCRIPTION OF THE INVENTION

The safety circuit 1 of the elevator is usually made as series-connected safety systems 2, which act upon the brake relay 6 integrated in the frequency converter 18 via the elevator control 3.

The brake relay 6 is a relay according to EN 954-1, category 4, or can be realized by means of two monitored relays. By means of the contacts 19, the brake relay 6 controls the brake 15 of the motor 14 and acts upon the safety switch via contact 10. The safety switch preferably conforms to EN 81-1. The motor 14 can include multiple AC motors although, preferably, it includes a single AC motor.

In order to reduce the contact wear, the power semiconductor 20 is connected in series with the contacts 19 of the brake relay 6. Due to the faster switching behavior of the power semiconductor 20, an erosion of the contact 19 is avoided. The power semiconductor 20 is also connected in series with the relay 17 that switchably connects to magnetizing current 16.

The logic unit 8 of the frequency converter 18 provides the pulse pattern to the power semiconductors located in the inverter forming the torque. The safety switch 9 blocks the pulse pattern, when the contacts 10 of the brake relay are open.

The power part of the frequency converter 18 comprises a rectifier 11 rectifying the mains voltage, a direct voltage intermediate circuit 12 and an inverter 13, which is preferably made of six power semiconductors. A defined switching of the power semiconductor will generate a three-phase alternating voltage with variable basic wave amplitude and frequency. The output of the inverter 13, which is connected to the magnetizing current 16, is electrically connected to the motor 14.

When the elevator control 3 receives a call 5, and the safety system 2 is dosed, the brake relay will be activated. Via the monitoring device 4, the elevator control 3 monitors the function of the brake relay 6.

By actuating the brake relay 6, the driving signals 7, such as driving direction and speed, will be transmitted to the frequency converter 18 from the elevator control.

In accordance with the driving signals, the frequency converter logic 8 generates a pulse pattern generating a rotating field for the power semiconductor.

As soon as the brake relay 6 is pulled in, the pulse patterns are switched from the safety switch 9 to the power semiconductors. Thus, based on the intermediate circuit voltage the power semiconductors can generate a rotating field with variable basic wave frequency through modulators.

When the brake relay is de-energized by an actuated safety system, on the one hand the brake is actuated and on the other hand the safety switch 9 is blocked. Thus, the rotating field of the motor 14 generating the torque is turned, off and the brake 15 retards the drive. This stops the drive.

The undesired starting of the drive is also avoided by this switching structure for as long as the brake relay is pulled in.

A defective power semiconductor in the inverter 13 causes disconnection or damaging of the power semiconductor in question. As the pulse pattern required for generating a rotating field is very complex, an incidental occurrence of a torque generating pulse pattern, for example caused by electromagnetic interference or component errors, can be prevented. In any case, the generation of a driving torque is avoided.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method for stopping elevators by using at least one AC motor driven by a static frequency converter, in which a brake relay controls the brake of the motor so that de-energizing the brake relay will brake the motor, the brake relay being connected with a safety switch in such a manner that de-energizing the brake relay will reliably block the control impulses required for generating the driving motor field.

2. The method according to claim 1, wherein a series-connected power semiconductor will disconnect faster than a contact of the brake relay used to control the brake.

3. The method according to claim 1, wherein if a safety system is triggered, a call will control the brake relay so that it is pulled in.

4. A system for implementation of the method according to claim 1, comprising an elevator safety circuit acting via the elevator control upon the brake relay located in the static frequency converter, the brake relay controlling the brake of the motor, the static frequency converter comprising a frequency converter logic unit that produces control signals, used by the motor control power semiconductors contained in the inverter, for a rotating-field-producing pulse pattern, and the safety switch, which is on the one side connected to the brake relay and on the other side to the motor control power semiconductors, so that de-energizing the brake relay will disconnect a torque-generating, rotating field of the at least one motor.

5. The system according to claim 4, wherein the brake relay used is an emergency-out relay conforming to EN 954-1, category 4.

6. The system according to claim 4, wherein only one brake relay is provided.

7. The system according to claim 4, wherein the frequency converter is located in a connection box or in a housing of the at least one motor.

8. The system according to claim 4, wherein the contact of the brake relay controlling the brake is connected in series with at least one of the motor control power semiconductor.

* * * * *